US008393306B2

(12) United States Patent
Schiffer et al.

(10) Patent No.: US 8,393,306 B2
(45) Date of Patent: Mar. 12, 2013

(54) INTERNAL COMBUSTION ENGINE OIL TANK ARRANGEMENT

(75) Inventors: Markus Schiffer, Gmund (AT); Michael Simmer, Seitenstetten (AT); Markus Hochmayr, Krenglbach (AT); Stefan Gruber, Roitham (AT); Manuel Gruber, Steyr (AT); Josef Burgstaller, Niederthalheim (AT); Clemens Hubauer, Wels (AT); Peter Junkowitsch, Wels (AT); Marc Renner, Alkoven (AT)

(73) Assignee: BRP-Powertrain GmbH & Co. KG, Gunskirchen (AT)

( * ) Notice: Subject to any disclaimer, the term of this patent is extended or adjusted under 35 U.S.C. 154(b) by 256 days.

(21) Appl. No.: 12/996,735

(22) PCT Filed: Jun. 27, 2008

(86) PCT No.: PCT/EP2008/058336

§ 371 (c)(1),
(2), (4) Date: Dec. 7, 2010

(87) PCT Pub. No.: WO2009/155997

PCT Pub. Date: Dec. 30, 2009

(65) Prior Publication Data

US 2011/0162613 A1 Jul. 7, 2011

(51) Int. Cl.
*F01M 13/00* (2006.01)

(52) U.S. Cl. ..... 123/41.86; 123/572; 123/574; 123/195 C; 123/196 R

(58) Field of Classification Search ..... 123/41.86, 123/572, 574, 195 C, 196 R
See application file for complete search history.

(56) References Cited

U.S. PATENT DOCUMENTS

| | | | |
|---|---|---|---|
| 5,167,207 | A | 12/1992 | Gohara et al. |
| 5,240,088 | A | 8/1993 | Okui et al. |
| 5,836,421 | A | 11/1998 | Leicht |

(Continued)

FOREIGN PATENT DOCUMENTS

| | | | |
|---|---|---|---|
| DE | 3633093 | A1 | 3/1988 |
| JP | 59113230 | | 6/1984 |

(Continued)

OTHER PUBLICATIONS

English Abstract of JP3050314, Published on Mar. 4, 1991.

(Continued)

*Primary Examiner* — Noah Kamen
*Assistant Examiner* — Grant Moubry
(74) *Attorney, Agent, or Firm* — BCF LLP

(57) ABSTRACT

An internal combustion engine has a crankcase, a crankshaft, a cylinder block, and cylinder head assembly. The cylinder block has at least one cylinder. At least one piston is disposed in the at least one cylinder. The at least one piston is operatively connected to the crankshaft. An oil tank enclosure is connected to at least one of the crankcase outer wall and the cylinder block outer wall. The oil tank enclosure and the at least one of the crankcase outer wall and the cylinder block outer wall together form an oil tank. The arrangement of the oil inlet, oil outlet, and blow-by gas outlet in an oil tank; an oil tank having an angled portion for separating blow-by gases from oil; and an arrangement of a blow-by gas passage connected to an oil tank are also described.

20 Claims, 8 Drawing Sheets

U.S. PATENT DOCUMENTS

| | | | | |
|---|---|---|---|---|
| 6,029,638 | A | 2/2000 | Funai et al. | |
| 6,591,820 | B2 * | 7/2003 | Kitano et al. | 123/572 |
| 7,059,311 | B2 * | 6/2006 | Prasad | 123/573 |
| 7,080,636 | B2 * | 7/2006 | Knaus et al. | 123/572 |
| 7,201,132 | B2 * | 4/2007 | Miyake et al. | 123/196 W |
| 7,243,642 | B2 * | 7/2007 | Nishikawa et al. | 123/572 |
| 2002/0129783 | A1 | 9/2002 | Lawrence | |
| 2003/0024512 | A1 * | 2/2003 | Kitano et al. | 123/572 |
| 2003/0073358 | A1 | 4/2003 | Dagenais et al. | |
| 2005/0092267 | A1 * | 5/2005 | Nonaka et al. | 123/41.86 |

FOREIGN PATENT DOCUMENTS

| | | | |
|---|---|---|---|
| JP | 60192821 | A * | 10/1985 |
| JP | 61079813 | A * | 4/1986 |
| JP | 61145311 | | 7/1986 |
| JP | 62023514 | | 1/1987 |
| JP | 62032209 | | 2/1987 |
| JP | 3050314 | | 3/1991 |
| JP | 6033729 | | 2/1994 |
| JP | 11081965 | | 3/1999 |
| JP | 11081972 | | 3/1999 |
| JP | 11093634 | | 4/1999 |
| RU | 2017983 | C1 | 8/1994 |
| SU | 1523690 | A1 | 11/1989 |

OTHER PUBLICATIONS

English Abstract of DE3633093, Published on Mar. 31, 1988.
English Abstract of JP11093634, Published on Apr. 6, 1999.
English Abstract of JP62032209, Published on Feb. 12, 1987.
English Abstract of JP6033729, Published on Feb. 8, 1994.
English Abstract of JP61145311, Published on Jul. 3, 1986.
English Abstract of JP59113230, Published on Jun. 29, 1984.
English Abstract of JP62023514, Published on Jan. 31, 1987.
English Abstract of JP11081972, Published on Mar. 26, 1999.
English Abstract of JP11081965, Published on Mar. 26, 1999.
English Abstract of patent No. SU1523690.

* cited by examiner

INTERNAL COMBUSTION ENGINE OIL TANK ARRANGEMENT

FIELD OF THE INVENTION

The present invention relates to a lubrication system for an internal combustion engine. More specifically, the present invention relates to an oil tank arrangement for an internal combustion engine.

BACKGROUND OF THE INVENTION

Internal combustion engines operating on the four-stroke principle have a lubrication system consisting of various passages inside the crankcase, cylinder block, and cylinder head assembly to lubricate the various components of the engine. On engines having a dry sump, the oil used for lubricating these components is stored in an oil tank. The oil flows from the oil tank to the passages and is returned to the oil tank from the passages after circulating though the engine.

The oil tank is generally in the form of a container that is separate from the engine. To permit oil to flow to and from the oil tank therefore requires various tubes or pipes to be connected between the oil tank and the engine. Installing these connections requires time during the assembly of the engine. Also, as would be understood, the more connections exist, the greater the likelihood of oil leaks. The oil tank, being a separate container, also needs to be installed in the vehicle where the engine is located, which can sometimes be difficult due to the lack of space in the vehicle, particularly in recreational vehicles such as snowmobiles or personal watercraft. Further increasing the difficulty in installing the oil tank in a vehicle is the importance, in relatively lightweight vehicles, to maintain a proper weight balance in the vehicle, which is the case in recreational vehicles. If a mass, such as the oil tank, is disposed in the wrong position, it could negatively affect the performance of the vehicle.

Therefore, there is a need for an internal combustion engine having an oil tank that does not require the above-mentioned connections and can be easily installed in a vehicle.

During the operation of the engine, some of the gases present in the combustion chambers pass through a gap between the pistons and the walls of the cylinders and enter the crankcase. These gases are known as blow-by gases. In the crankcase, the blow-by gases mix with oil droplets. The mixture of blow-by gases and oil droplets present in the crankcase is then returned to the oil tank.

Upon returning to the oil tank, some of the blow-by gases will separate from the oil and rise to the top of the oil tank. However, some of the blow-by gases may remain mixed with the oil. If the blow-by gases are recirculated with the oil in the passages of the lubrication system, they can become trapped in portions of the passages creating a "bubble" of blow-by gases. The portion of the engine where the bubble is located can become very hot since no oil flows in that portion of the passages, which could damage the engine.

Therefore there is a need to separate the blow-by gases from the oil prior to recirculating the oil in the passages of the lubrication system.

The blow-by gases that rise to the top of the oil tank need to be evacuated, otherwise pressure could build up inside the oil tank which could lead to oil leaking from the oil tank or even failure of the oil tank.

To address this problem, most oil tanks are provided with a blow-by gas outlet near or at the top portion thereof which communicates with the exterior of the engine (i.e. the environment or an air intake system of the engine). This outlet allows the blow-by gases to be vented to the exterior of the engine.

If for some reason, the vehicle in which the oil tank is disposed should become overturned, the oil needs to be prevented from leaking into the environment or the air intake system of the engine (as the case may be) via the blow-by gas outlet. This is usually achieved by providing a valve that closes upon detecting that the vehicle has overturned, thus preventing the oil from flowing to the environment or the air intake system of the engine. However, the valve could potentially fail or the sensor associated with the valve could not detect that the vehicle has overturned, which would lead to oil leaking into the environment or the air intake system of the engine. The sensor could also fail and cause the valve to close even though the vehicle did not overturn, which could lead to pressure build-ups inside the oil tank. Also, a valve, and its associated sensor, add cost to the manufacturing of the engine and oil tank and require additional assembly.

Therefore, there is a need to prevent oil from leaking into the environment or the air intake system of the engine when the vehicle in which the oil tank is located becomes overturned without requiring a valve.

Also, when a vehicle such as a snowmobile or all-terrain vehicle goes up or down a hill, or a vehicle such as a personal watercraft or a motorcycle takes a sharp turn, the vehicle becomes angled relative to horizontal, and if that angle is large enough, it may cause the oil in the oil tank to block the blow-by gas outlet. The blow-by gas outlet, being located at or near the top of the oil tank, also becomes blocked when the vehicle overturns. However, the blow-by gases still need to be vented under those conditions.

Therefore, there is a need for an oil tank that can vent blow-by gases even though the blow-by gas outlet becomes blocked by the oil in the oil tank due to the oil tank being angled relative to horizontal or being overturned.

SUMMARY OF THE INVENTION

It is an object of the present invention to ameliorate at least some of the inconveniences present in the prior art.

It is also an object of the present invention to provide an internal combustion engine having an integrated oil tank. A part of the oil tank is formed by at least one of the crankcase and the cylinder block. The other part of the oil tank is formed by a enclosure connected to the at least one of the crankcase and the cylinder block.

Integrating the oil tank with the engine eliminates the need for tubes or pipes to be installed between the oil tank and the engine. Also since the oil tank is integrated with the engine, when the engine is installed in the vehicle, the oil tank is simultaneously installed.

It is another object of the present invention to provide an engine having an oil tank with an angled portion. Oil entering the oil tank from the engine flows over the angled portion which causes blow-by gases present in the oil to become separated from the oil.

It is yet another object of the present invention to provide an engine having an oil tank with a blow-by gas outlet where the blow-by gas outlet communicates with a blow-by gas passage which first extends in a direction generally away from the cylinder head assembly, and then extends generally back towards the cylinder head assembly. Due to the shape of the blow-by gas passage, the likelihood of oil leaking into the environment or the air intake system of the engine when the engine and oil tank become overturned is reduced.

It another object of the present invention to provide an engine having an oil tank with a blow-by gas outlet and an oil inlet, where the oil inlet is arranged such that, should the blow-by gas outlet become blocked by the oil in the oil tank due to the oil tank being angled relative to horizontal or being overturned, oil can be vented to the atmosphere via the inlet.

In one aspect, the invention provides an internal combustion engine having a crankcase, a crankshaft disposed in the crankcase, and a cylinder block disposed on the crankcase. The crankcase has a crankcase outer wall. The cylinder block has at least one cylinder. The cylinder block has a cylinder block outer wall. At least one piston is disposed in the at least one cylinder. The at least one piston is operatively connected to the crankshaft. A cylinder head assembly is connected to the cylinder block. An oil tank enclosure is connected to at least one of the crankcase outer wall and the cylinder block outer wall. The oil tank enclosure and the at least one of the crankcase outer wall and the cylinder block outer wall together form an oil tank.

In a further aspect, an oil tank filler neck is connected to the oil tank enclosure. An oil tank cap selectively closes the oil tank filler neck.

In an additional aspect, an oil tank wall extends outwardly from the at least one of the crankcase outer wall and the cylinder block outer wall. The oil tank enclosure is connected to the oil tank wall. The oil tank enclosure, the at least one of the crankcase outer wall and the cylinder block outer wall, and the oil tank wall together form the oil tank.

In a further aspect, the at least one of the crankcase outer wall and the cylinder block outer wall is the crankcase outer wall.

In an additional aspect, an oil outlet is disposed in the crankcase. The oil outlet fluidly communicates with the oil tank for supplying oil from the oil tank to the engine. An oil inlet is disposed in the crankcase. The oil inlet fluidly communicates with the oil tank for supplying oil from the engine to the oil tank.

In a further aspect, a blow-by gas outlet is disposed in the crankcase. The blow-by gas outlet fluidly communicates the oil tank with an exterior of the engine.

In an additional aspect, the oil inlet is disposed in the crankcase outer wall.

In another aspect, the invention provides an internal combustion engine having a crankcase, a crankshaft disposed in the crankcase, and a cylinder block disposed on the crankcase. The crankshaft defines a crankshaft axis. The cylinder block has at least one cylinder. The at least one cylinder defines a cylinder axis. At least one piston is disposed in the at least one cylinder. The at least one piston is operatively connected to the crankshaft. A cylinder head assembly is connected to the cylinder block. A plurality of oil passages is disposed in at least one of the crankcase, the cylinder block, and the cylinder head assembly. An oil tank is fluidly connected to at least one of the oil passages. The oil tank has a first side and a second side opposite the first side. An oil outlet is disposed in the oil tank. The oil outlet fluidly communicates the oil tank with at least one of the oil passages for supplying oil from the oil tank to the oil passages. An oil inlet is disposed in the first side of the oil tank. The oil inlet fluidly communicates with at least one of the plurality of oil passages for returning a mixture of oil and blow-by gases from the at least one of the plurality of oil passages to the oil tank. An angled portion of the second side of the oil tank generally facing the oil inlet is angled relative to a plane defined by the crankshaft axis and the cylinder axis such that the mixture of oil and blow-by gases exiting the oil inlet flow over the angled portion.

In a further aspect, a blow-by gas outlet fluidly communicates the oil tank with an exterior of the engine.

In an additional aspect, the first side of the oil tank is at least in part an outer wall of the crankcase. The second side of the oil tank is an oil tank enclosure connected to the crankcase.

In a further aspect, an angle between the angled portion of the second side of the oil tank and the plane is between 45 degrees and 80 degrees.

In an additional aspect, an axis normal to the oil inlet is generally perpendicular to the plane.

In yet another aspect, the invention provides an internal combustion engine having a crankcase, a crankshaft disposed in the crankcase, and a cylinder block disposed on the crankcase. The crankshaft defines a crankshaft axis. The cylinder block has at least one cylinder. The at least one cylinder defines a cylinder axis. At least one piston is disposed in the at least one cylinder. The at least one piston is operatively connected to the crankshaft. A cylinder head assembly is connected to the cylinder block. A plurality of oil passages is disposed in at least one of the crankcase, the cylinder block, and the cylinder head assembly. An oil tank is fluidly connected to at least one of the oil passages. The oil tank has a first end portion and a second end portion opposite the first end portion. The first end portion is closer to the cylinder head assembly than the second end portion. An oil outlet is disposed in the second end portion of the oil tank for supplying oil from the oil tank to at least one of the crankcase, the cylinder block, and the cylinder head assembly. An oil inlet is disposed in the oil tank for returning oil from at least one of the crankcase, the cylinder block, and the cylinder head assembly to the oil tank. A blow-by gas outlet is disposed in the first end portion of the oil tank. A blow-by gas passage fluidly communicates the blow-by gas outlet with an exterior of the engine. A first portion of the blow-by gas passage extends from the blow-by gas outlet in a direction generally away from the cylinder head assembly, and a second portion of the blow-by gas passage extends from the first portion of the blow-by gas passage in a direction generally towards the cylinder head assembly, such that when the first end portion of the oil tank is disposed generally vertically above the second end portion of the oil tank, blow-by gases in the oil tank flow sequentially from the oil tank to the blow-by gas outlet, to the first portion of the blow-by gas passage, to the second portion of the blow-by gas passage, and to the exterior of the engine.

In a further aspect, the blow-by gas outlet is disposed generally at a center of a length of the first end portion of the oil tank. The length of the first end portion of the oil tank is generally parallel to the crankshaft axis.

In an additional aspect, the oil inlet is arranged in the oil tank such that when the first end portion of the oil tank is disposed generally vertically below the second end portion of the oil tank, blow-by gases in the oil tank flow sequentially from the oil tank to the oil inlet, and to the exterior of the engine.

In a further aspect, the oil inlet returns oil from the cylinder head assembly. When the first end portion of the oil tank is disposed generally vertically below the second end portion of the oil tank, blow-by gases in the oil tank flow to the cylinder head assembly prior to flowing to the exterior of the engine.

In an additional aspect, the oil inlet is a first oil inlet. The engine also has a second oil inlet in the oil tank for returning oil from at least one other of the crankcase, the cylinder block, and the cylinder head assembly to the oil tank. The first and second oil inlets are disposed between the blow-by gas outlet and the oil outlet in a direction generally parallel to the cylinder axis. The first oil inlet is disposed closer than the second oil inlet to the blow-by gas outlet.

In a further aspect, at least one oil pumps oil from at least one of the crankcase and the cylinder block to the oil tank. The first oil inlet returns oil from the at least one oil pump. The second oil inlet returns oil from the cylinder head assembly.

In an additional aspect, the first portion of the blow-by gas passage extends in the crankcase. The second portion of the blow-by gas passage is a timing chain case of the engine fluidly communicating with the cylinder head assembly. When the first end portion of the oil tank is disposed generally vertically above the second end portion of the oil tank, blow-by gases in the oil tank flow to the cylinder head assembly prior to flowing to the exterior of the engine.

In a further aspect, when the first end portion of the oil tank is disposed generally vertically above the second end portion of the oil tank, blow-by gases in the oil tank flow to the cylinder head assembly prior to flowing to the exterior of the engine. The engine also has a blow-by gas separator disposed in the cylinder head assembly for separating oil from the blow-by gases prior to the blow-by gases flowing to the exterior of the engine.

In an additional aspect, the oil tank is formed by an outer wall of the crankcase and by an oil tank enclosure connected to the crankcase.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Although the engine 10 of the present invention is being described herein as being usable in a personal watercraft or a snowmobile, it should be understood that it would also be possible to use this engine in other applications, such as, for example, all-terrain vehicles and motorcycles.

Figure 1:
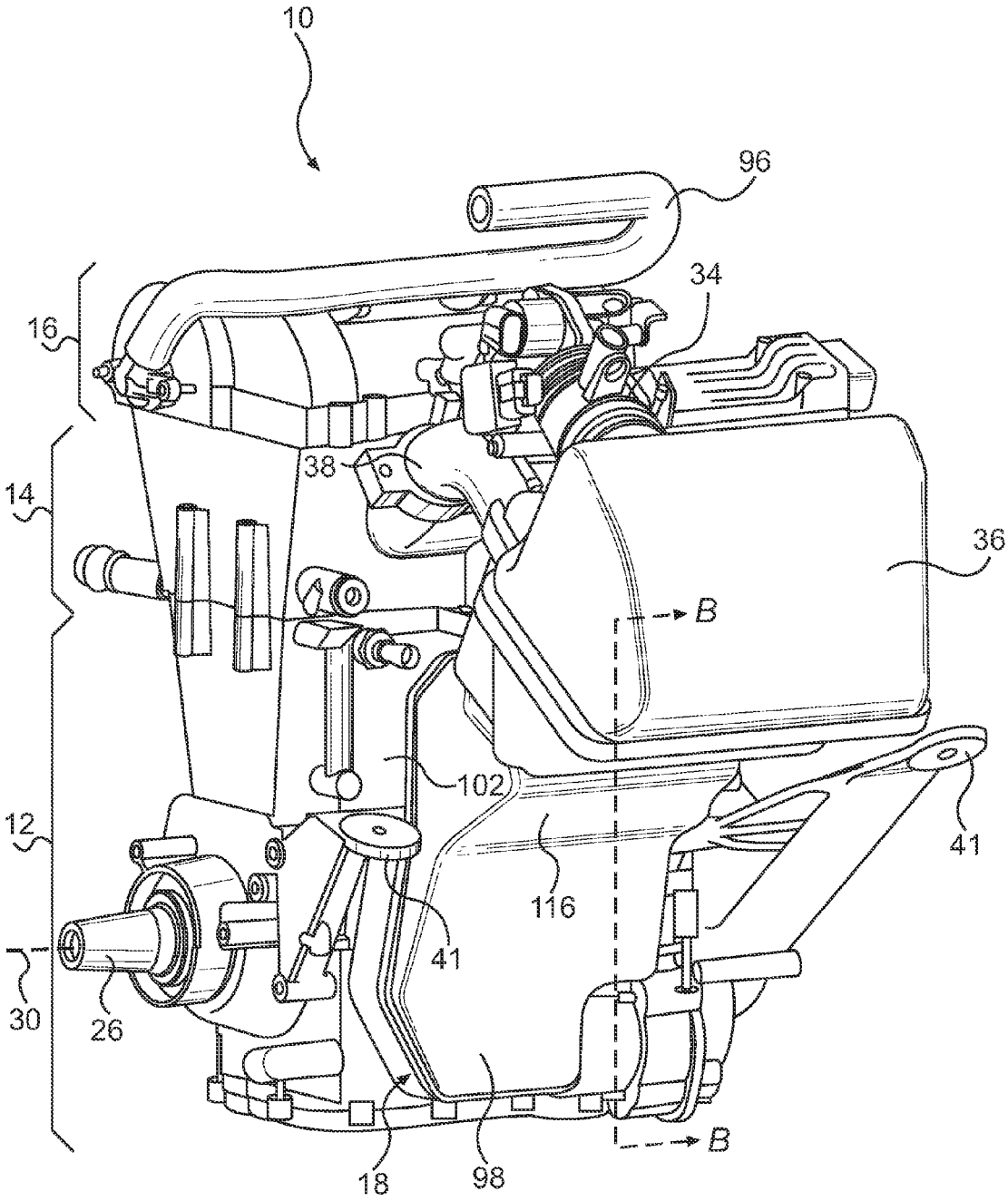
FIG. 1 is a perspective view of an internal combustion engine.
Figure 8:
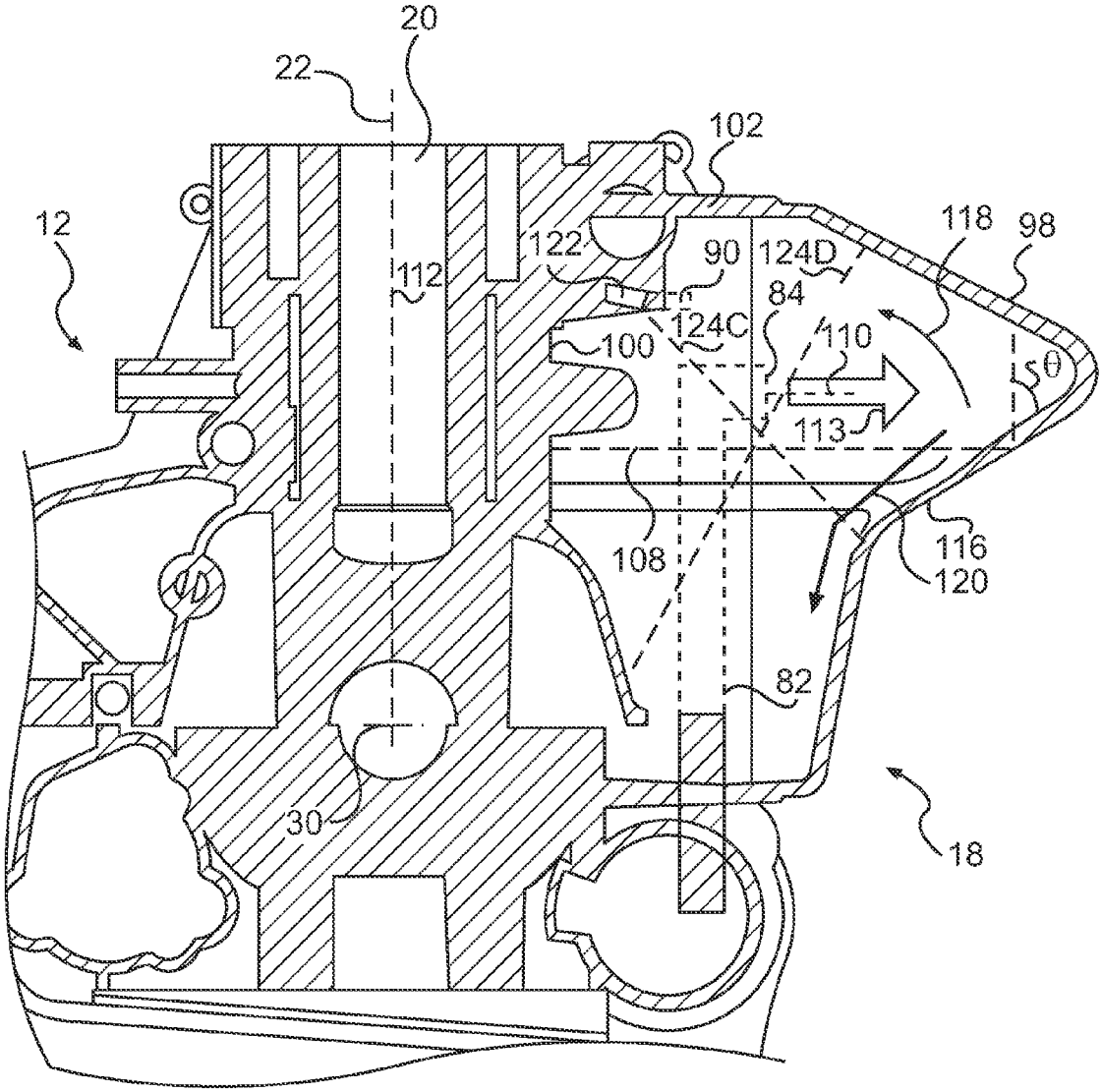
FIG. 8 is a cross-sectional view, taken through line B-B of FIG. 1, of a crankcase and oil tank enclosure assembly of the engine of FIG. 1.

As can be seen in FIG. 1, the engine 10 has a crankcase 12, a cylinder block 14 disposed on and connected to the crankcase 12, and a cylinder head assembly disposed on and connected to the cylinder block 14. It is contemplated that the crankcase 12 and the cylinder block 14 could be integrally formed as a single component. The engine 10 also has an oil tank 18 integrally formed therein. Details regarding the construction of the oil tank 18 will be discussed in greater detail below. The engine 10 is what is known as a four-stroke, two-cylinder, in-line engine, which means that it has two cylinders 20 disposed in a straight line next to each other. It is contemplated that a greater or fewer number of cylinders 20 could be used. It is also contemplated that aspects of the engine 10 could also be used in other types of engines, such as V-type engines. Each cylinder 20 has an upper portion thereof formed in the cylinder block 14 and a lower portion thereof formed in the crankcase 12. It is contemplated that the cylinders 20 could be formed in the cylinder block 14 only. Each cylinder 20 defines a cylinder axis 22 (FIG. 8).

A piston 24 (FIG. 2) is disposed in each cylinder 20 for reciprocal movement therein along the cylinder axis 22. Each piston 24 is connected to a crankshaft 26 of the engine 10 via connecting rods 28. The crankshaft 26 is supported by bearings 31, 32, and 33 (FIG. 2) in the crankcase 12. Explosions caused by the combustion of an air/fuel mixture in the cylinders 20 cause reciprocal movement of the pistons 24. The reciprocal movement of the pistons 24 causes the crankshaft 26 to rotate in the crankcase 12, thus power can be transmitted from the end of the crankshaft 26 extending from the crankcase 12. The end of the crankshaft 26 could be operatively connected to the wheels or track of a vehicle, or to the propulsion unit (propeller or jet pump for example) of watercraft for example. It is contemplated that the crankshaft 26 could be made in two parts. In a two-part crankshaft, the first part is disposed inside the crankcase 12 and is connected to the connecting rods 28 and the second part extends from the crankcase 12 and is connected to the first part so as to rotate therewith. The crankshaft 26 defines a crankshaft axis 30.

Air is supplied to each cylinder 20 by an air intake system (FIG. 1) which consists of a throttle body 34, an air box (or intake manifold) 36, and two pipes 38 (one per cylinder 20). Air first enters through the throttle body 32. A throttle valve (not shown) is disposed inside the throttle body 34. The throttle valve is operatively connected to a throttle actuator (such as a pedal or a lever) of the vehicle in which the engine 10 is disposed, which is used to control a position of the throttle valve, and thus regulates the flow of air to the cylinders 20. From the throttle body 34, air flows to the air box 36. The air box 36 contains an air filter and a flame arrester (not shown). If the engine 10 is to be used in a wet environment, such as when the engine 10 is used in a watercraft, the air box 36 is also preferably provided with an air/water separator to ensure that no water enters the engine 10. From the air box 36, air flows to the pipes 38, and from there to the air intake passage(s) (not shown) of each cylinder 20. Intake valves (not shown) disposed in the air intake passages selectively communicate the air intake passages with the cylinders 20. Fuel injectors (not shown) disposed in the cylinder head assembly 16 inject fuel in the air intake passages thus creating the air/fuel mixture to be combusted in the cylinders 20. A spark plug (not shown) is provided in the cylinder head assembly 16 for each cylinder 20 to ignite the air/fuel mixture in each cylinder 20. Once combusted, the combusted mixture (i.e. exhaust gases) is exhausted via the exhaust passage(s) (not shown) of each cylinder 20. Exhaust valves (not shown) disposed in the exhaust passages selectively communicate the exhaust passages with the cylinders 20. From the exhaust passages, the exhaust gases flow through an exhaust system (not shown) and are then released to the atmosphere. The intake and exhaust valves are actuated by cams (not shown) mounted on two camshafts (one for the intake valves and one for the exhaust valves) (not shown) disposed in the cylinder head assembly 16. It is contemplated that a single camshaft could be used. The camshafts are driven by the crankshaft 26, preferably via a timing chain, and are rotatably supported by camshaft bearings 40 (FIG. 2).

The engine 10 is mounted to a vehicle via engine mount brackets 41 (some of which are not shown in FIG. 1) extending from the crankcase 12. The engine 10 can be mounted with the crankshaft 26 extending generally transverse to the longitudinal centerline of the vehicle, such as in a snowmobile, or with the crankshaft 26 extending generally parallel to the longitudinal centerline of the vehicle, such as in a personal watercraft. In a snowmobile, the engine 10 is preferably installed such that the portion of the crankshaft 26 which extends from the crankcase 12 extends towards the left of the snowmobile and, as such, the oil tank 18 is disposed on the side of the engine 10 facing towards the back of the snowmobile. In a personal watercraft, the engine 10 is preferably installed such that the portion of the crankshaft 26 which extends from the crankcase 12 extends towards the back of the personal watercraft and, as such, the oil tank 18 is disposed on the side of the engine 10 facing towards the right of the personal watercraft.

As would be understood by a person skilled in the art, the engine 10 is provided with many other components and systems, such as a fuel system, a cooling system, an electrical system and their respective components. U.S. patent application Ser. No. 11/960,566 (the '566 application), filed Dec. 19, 2007, the entirety of which is incorporated herein, provides a description of other components and systems which could be incorporated in the engine 10. The '566 application also provides additional detail as to the construction and features of some of the components and systems described above and below.

Figure 2:
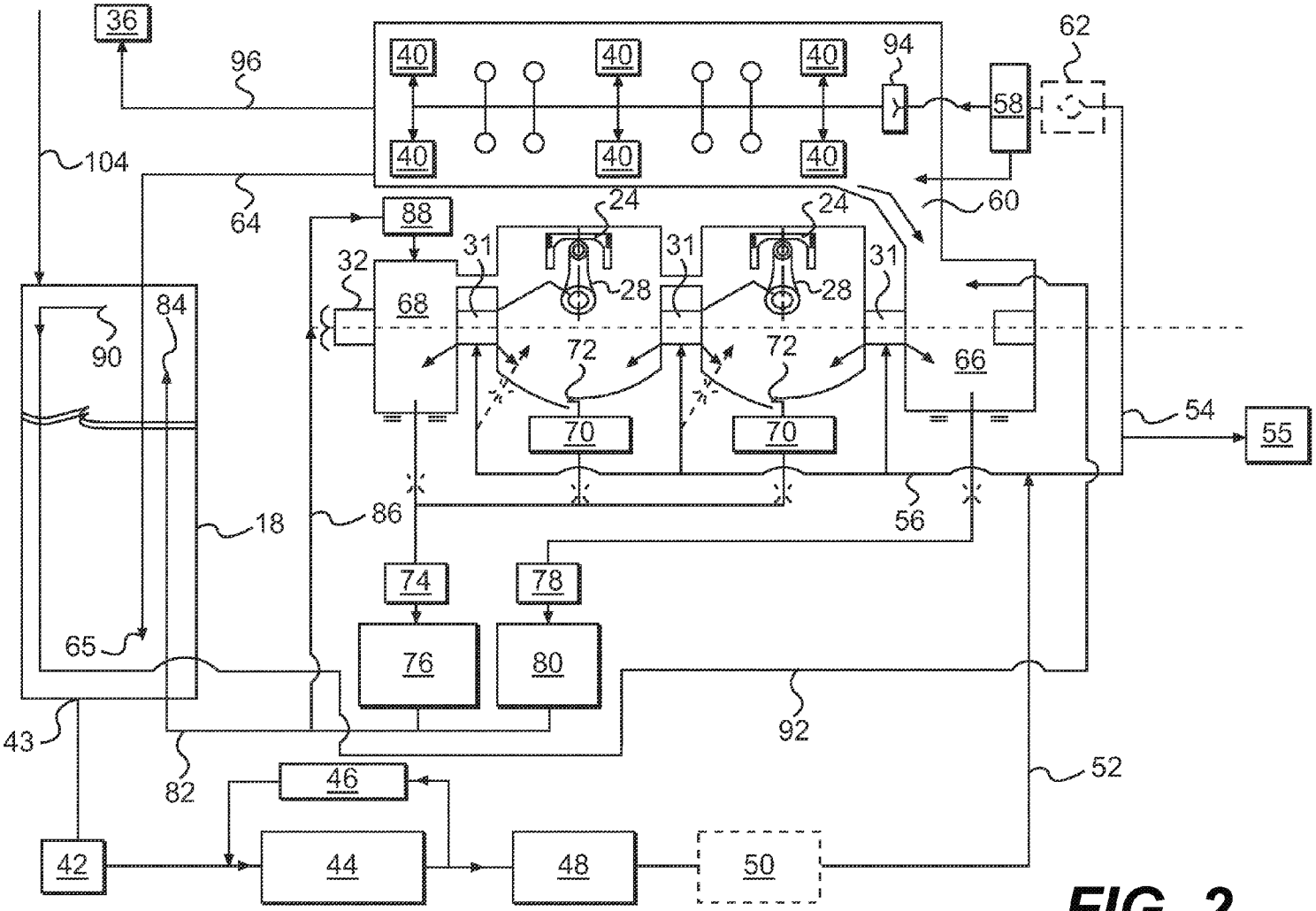
FIG. 2 is a schematic illustration of a lubrication system of the engine of FIG. 1.

Turning now to FIG. 2, the lubrication system of the engine 10 and engine components associated therewith will be described. The engine 10 has a dry sump lubrication system. Oil is stored in the oil tank 18. The oil is pumped out of the oil tank 18 via oil outlet 43 (see FIG. 3) through an oil sieve 42 by an oil pressure pump 44. The oil pressure pump 44 is preferably an internal gear pump disposed in the crankcase 12 and driven by the crankshaft 26. An internal gear pump is a type of positive-displacement pump which uses an external spur gear disposed inside an internal spur gear, with the external spur gear acting as the drive gear. A pressure regulating valve 46 is provided downstream of the oil pressure pump 44. The pressure regulating valve 46 will open to return the oil upstream of the oil pressure pump 44 should the pressure inside the lubrication system become too high.

From the oil pressure pump 44, the oil flows through an oil filter 48. The oil filter 48 filters out debris and impurities from the oil. An oil filter bypass valve (not shown) may be provided. The oil filter bypass valve would open if oil pressure builds up at the inlet of the oil filter 48, such as if the oil filter 48 becomes clogged, thus permitting oil to continue to flow inside the lubrication system. It is contemplated that the oil filter bypass valve could be integrated with the oil filter 48. The oil then flows to an oil cooler 50. It is contemplated that it may not be necessary to include the oil cooler 50.

From the oil cooler 50 (or the oil filter 48 should the oil cooler be omitted), the oil flows to the main oil gallery 52, and from there it gets separated into two main paths 54, 56. An oil pressure sensor 55 senses the pressure of the oil in the first main path 54 to determine whether the lubrication system is operating properly. The oil flowing through the first main path 54 first lubricates a chain tensioner 58. The chain tensioner 58 is used to tension the timing chain driving the camshafts from the crankshaft 26 as described in the '566 application. The timing chain is disposed in a timing chain case 60 (FIG. 3) of the engine 10. A one-way valve 62 may optionally be provided upstream of the chain tensioner 58 to prevent oil from flowing back from the chain tensioner 58 and the components disposed downstream thereof in the first main path towards the main oil gallery 52 when the engine 10 is stopped. From the chain tensioner 58, some of the oil flows down the timing chain case 60, lubricating the timing chain in the process, and the remainder of the oil flows to the cylinder head assembly 16.

From the chain tensioner 58, the oil flowing inside the cylinder head assembly 16 from the first main path 54 lubricates the bearings 40 of the two camshafts. Some of the oil flowing inside the cylinder head assembly 16 is also sprayed on the mechanism used to actuate the intake and exhaust valves. From the cylinder head assembly 16 some of the oil flows back to the oil tank 18 via passage 64 and enters the oil tank 18 via oil inlet 65 (see FIGS. 3-5). The remainder of the oil flows down inside the timing chain case 60 to the bottom of a chamber 66 (FIG. 5) located at the end of the engine 10 where the crankshaft 26 extends out of the crankcase 12, lubricating the components found, at least partially, therein in the process. These components are the bearing 33, the timing chain, and various gears and sprockets (not shown) found therein to drive other components of the engine 10.

A portion of the oil flowing through the second main path 56 is used to lubricate the bearings 31 of the crankshaft 26. The bearing 32 of the crankshaft 26 is lubricated by oil flowing from the leftmost bearing 31 (as shown in FIG. 2) to the bearing 32 via an oil passage (not shown) in the crankshaft 26. The oil lubricating the bearing 32 then flows down to the bottom of the ignition case 68 (FIG. 5, however note that a cover is missing in FIG. 5 to close the ignition case 68). The ignition case 68 contains the magneto (not shown). The magneto is connected to the crankshaft 26 to produce electrical power while the engine 10 is running to power some engine systems (for example the charging and fuel injection systems) and vehicle systems (for example lights and display gauges). A portion of the oil lubricating the bearings 31 then flows to the bottom of the crankcase 12. A portion of the oil lubricating the rightmost and leftmost bearings 31 (as shown) also flows to the chamber 66 and the ignition case 68 respectively. From the bottom of the crankcase 12, the oil then flows to the collecting tanks 70, which are disposed below the crankcase 12, via openings 72 in the bottom of the crankcase 12.

Another portion of the oil flowing through the second main path 56 is sprayed inside the crankcase 12 so as to spray the bottom of the pistons 24. By doing this, the oil both cools the pistons 24 and lubricates the piston pins (not shown). The oil then falls down to the bottom of the crankcase 12 and then to the collecting tanks 70.

The oil which flows inside the ignition case 68 from various sources as described above, and the oil in the collecting tanks 70 flows through the oil sieve 74, and is pumped by the oil evacuation pump 76. The oil evacuation pump 76 is preferably an internal gear pump disposed in the crankcase 12 and driven by the crankshaft 26.

The oil which flows inside the chamber 66 from various sources as described above, flows through oil sieve 78 and is pumped by the oil suction pump 80. The oil suction pump 80 is preferably an internal gear pump disposed in the crankcase and driven by the crankshaft 26.

Figure 3:
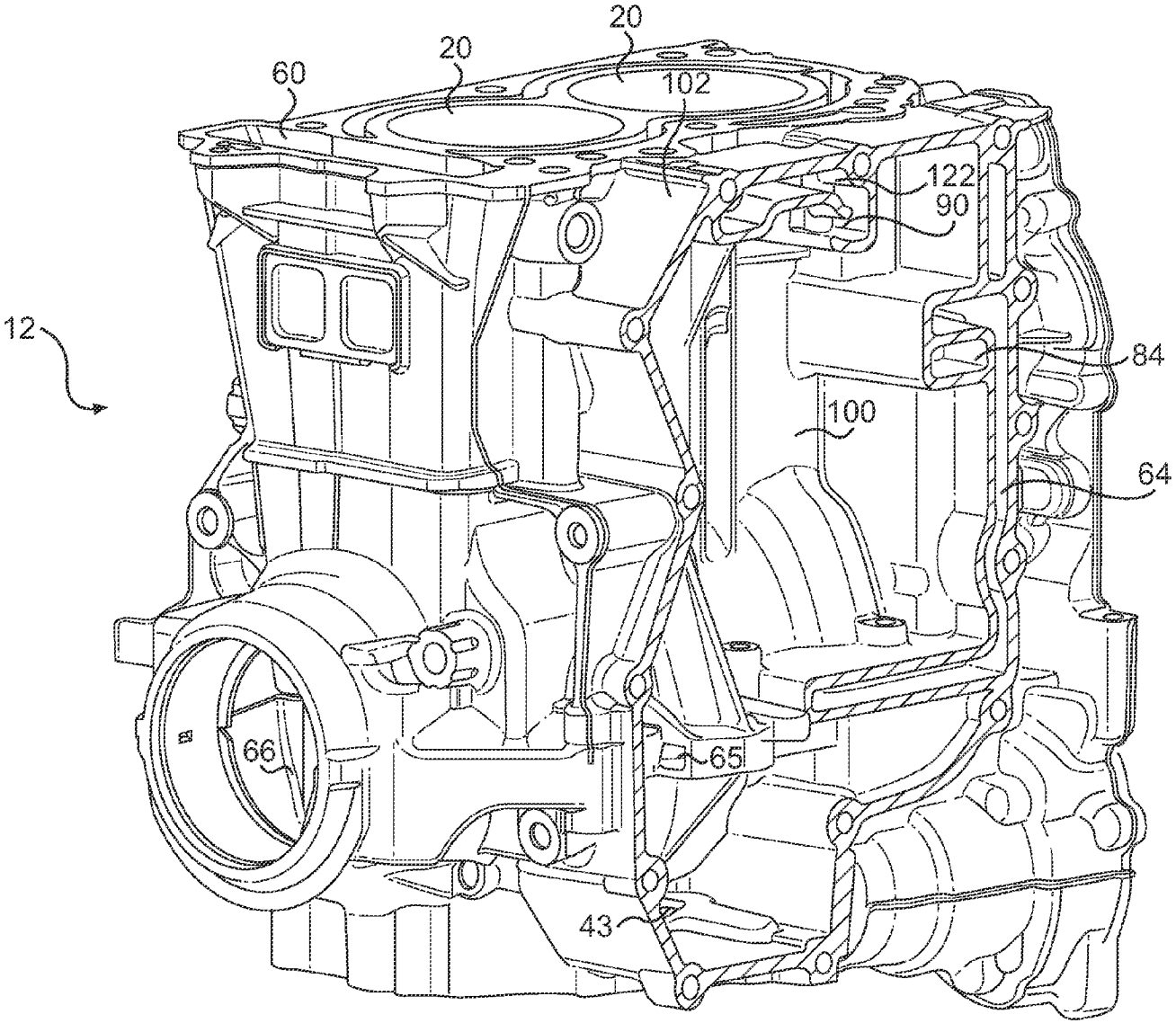
FIG. 3 is perspective view of a crankcase of the engine of FIG. 1.
Figure 4:
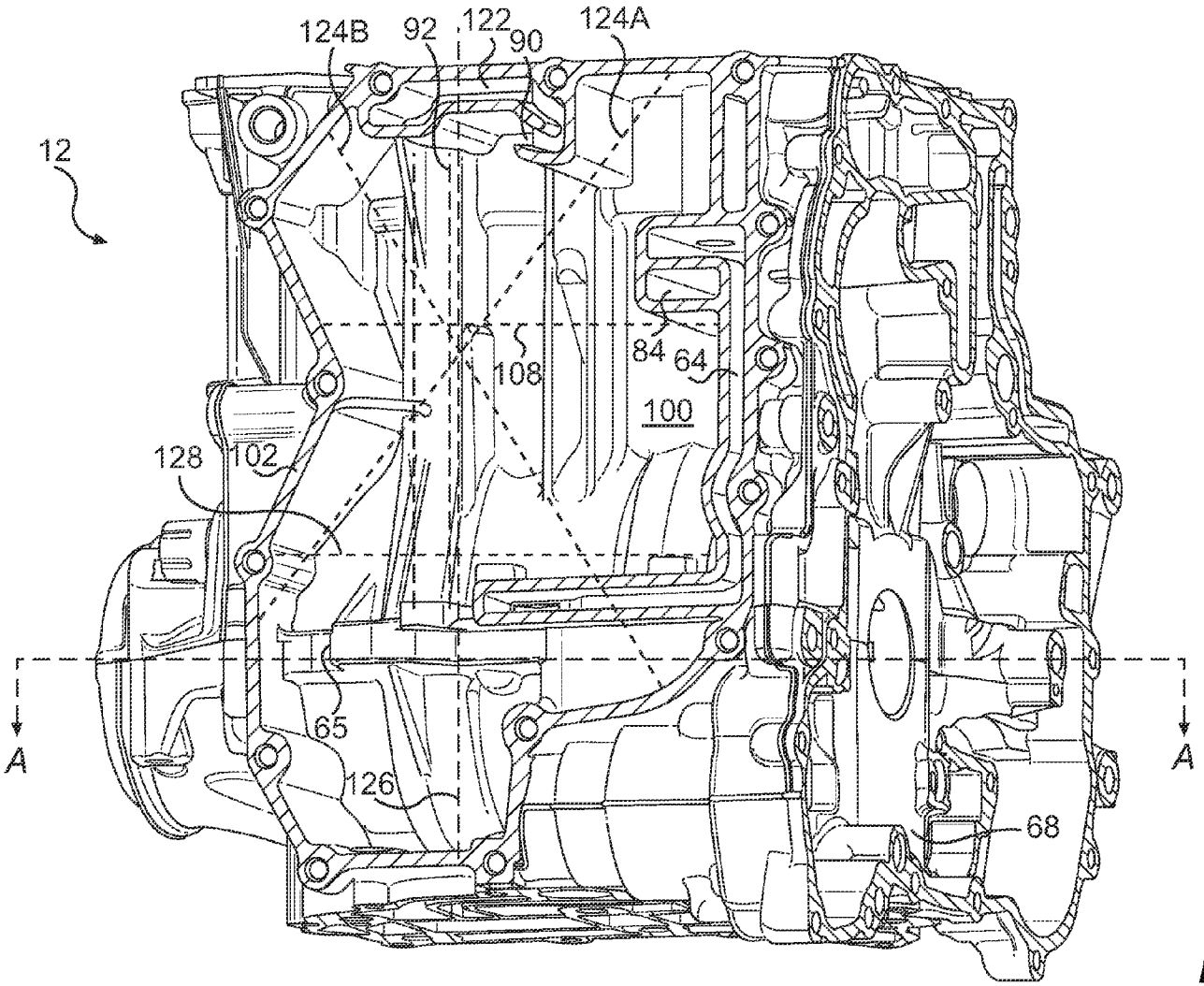
FIG. 4 is another perspective view of the crankcase of FIG. 3.

From the oil pumps 76 and 80 oil flows back to the oil tank 18 via passage 82 and a majority thereof enters the oil tank 18 via oil inlet 84 (see FIGS. 3, 4, and 8). The portion of the oil in the passage 82 which is not returned to the oil tank 18 flows through passage 86 and lubricates the bearing 88. The bearing 88 is used to rotatably mount a water pump (not shown) of the engine 10 on a shaft (not shown). The water pump is used to pump water through the cooling system of the engine 10. From the bearing 88, the oil flows to the ignition case 68 and is returned to the oil tank 18 as described above.

In the crankcase 12, the blow-by gases mix with the oil droplets. The mixture of blow-by gases and oil droplets present in the crankcase 12 is pumped along with the oil by the evacuation pump 76 back to oil tank 18. As described in greater detail below, once in the oil tank 18, the blow-by gases are separated from the oil. As is also described in greater detail below, when the oil tank 18 is oriented as shown in FIG. 1, the blow-by gases, and any oil vapour present in the oil tank 18, flow out of the oil tank via the blow-by gas outlet 90 (see FIGS. 3 and 4), flow down in blow-by gas passage 92 (shown in phantom in FIG. 4), enter the chamber 66, and flow up the chain case 60 to the cylinder head assembly 16. Once in the cylinder head assembly 16, a blow-by gas separator 94, which is actuated by one of the camshafts, acts as a centrifuge which causes oil droplets mixed with the blow-by gases to separate from the mixture and to fall down the timing chain case 60 to the bottom of the chamber 66 where they are returned to the oil tank 18 by the oil suction pump 80. The blow-by gas separator 94 is preferably of the type shown and described in the '566 application. The remaining blow-by gases enter a blow-by tube 96 (FIG. 1) and flow to an exterior of the engine 10. In the embodiment shown, the blow-by tube 96 fluidly communicates with the air box 26 where the blow-by gases are mixed with fresh air and are then returned to the combustion chambers. However, it is contemplated that the blow-by tube 96 could fluidly communicate with an environment of the engine 10, thus releasing the blow-by gases in the environment.

Turning now to FIGS. 3 to 8, the oil tank 18 will be described in more detail. The oil tank 18 is integrally formed in the engine 10 and consists of an oil tank enclosure 98 connected to an outer wall 100 of the crankcase 12 by a plurality of fasteners (not shown). More specifically, an oil tank wall 102 extends outwardly from the crankcase 12 and the oil tank enclosure 98 is connected to the oil tank wall 102, such that the oil tank 18 is formed by the oil tank enclosure 98, the outer wall 100, and the oil tank wall 102. It is contemplated that in addition to or instead of the outer wall 100 of the crankcase 12, that the oil tank 18 could be formed using an outer wall of the cylinder block 14.

Figure 6:
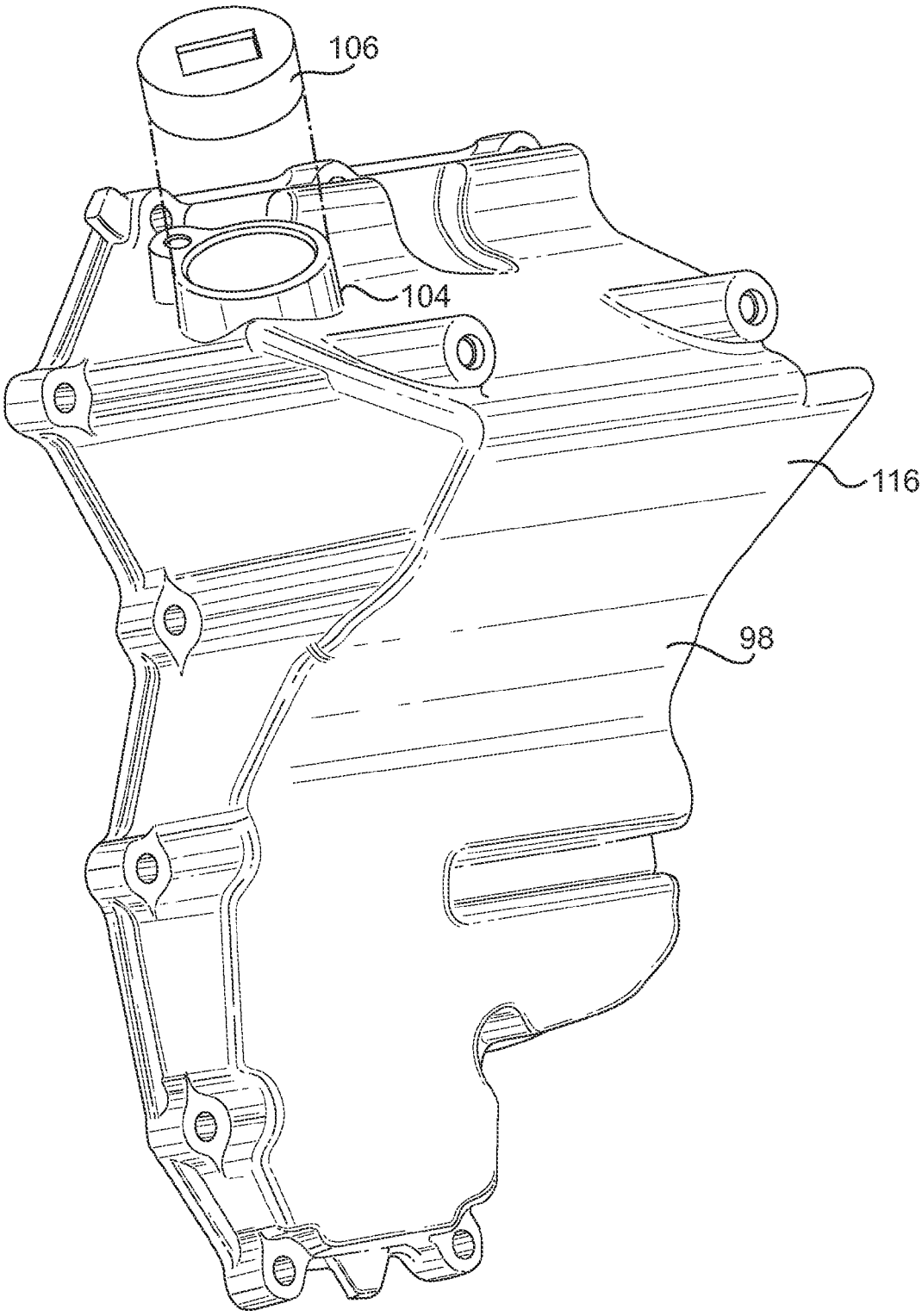
FIG. 6 is a perspective view of an outside of an oil tank enclosure of the engine of FIG. 1.
Figure 7:
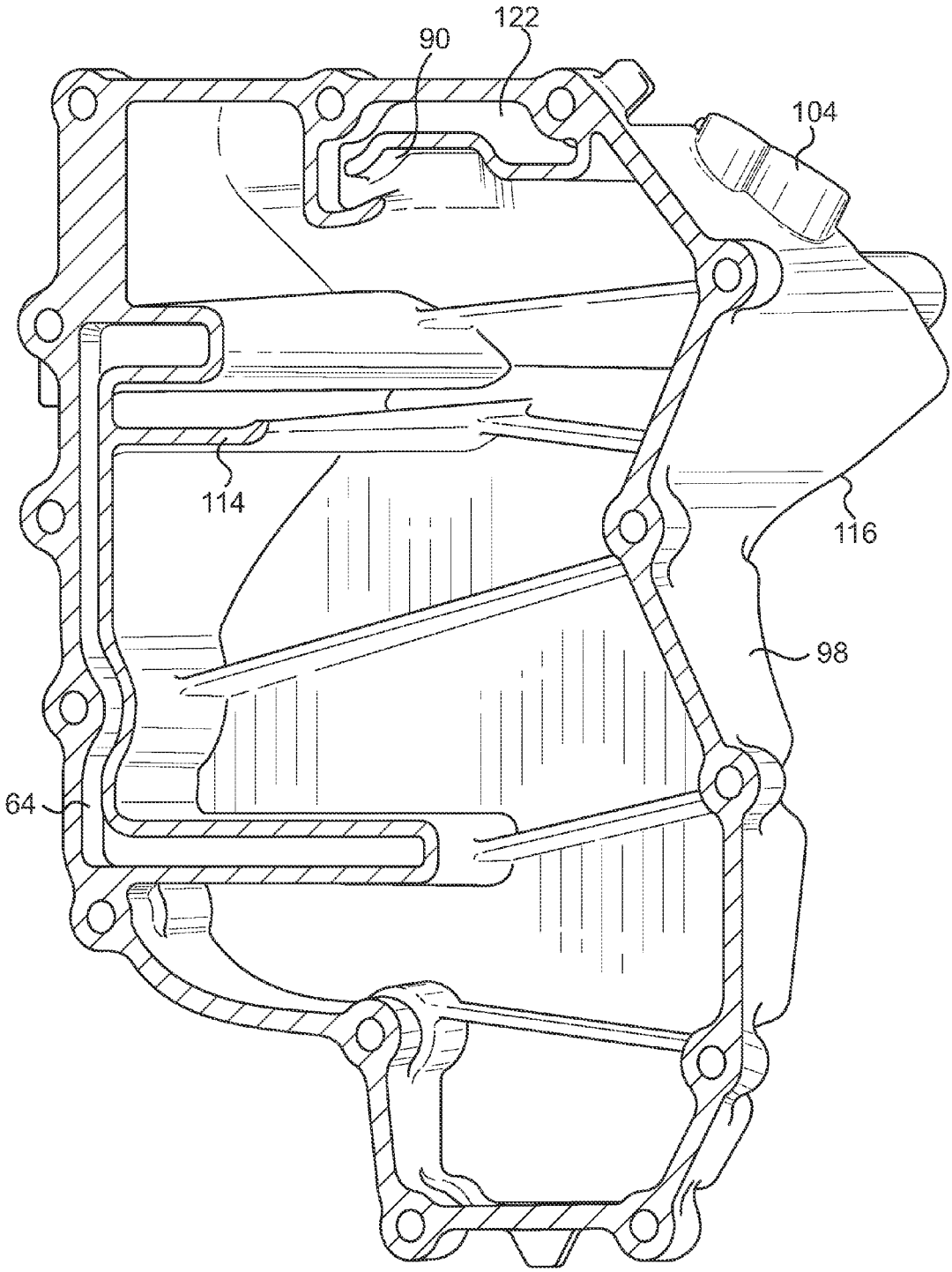
FIG. 7 is a perspective view of an inside of the oil tank enclosure of FIG. 6.

The oil tank 18 is filled with oil via an oil tank filler neck 104 on the top of the oil tank enclosure 98 (FIG. 6). The oil tank filler neck 104 is closed by an oil tank cap 106. A dipstick (not shown) which extends into the oil tank 18 to allow a user to determine the level of oil in the oil tank 18 is preferably connected to the inner surface of the oil tank cap 106.

As can be seen in FIGS. 3 and 4, the oil inlet 84 is formed in the crankcase outer wall 100. When the engine 10 is level, the oil inlet 84 is disposed above the oil level (indicated by line 108 in FIGS. 4 and 8, which corresponds to the maximum recommended amount of oil in the oil tank 18). As can be seen in FIG. 8, an axis 110 that is normal to the oil inlet 84 is generally perpendicular to a plane 112 defined by the crankshaft axis 30 and the cylinder axis 22. Oil flowing into the oil tank 18 from inlet 84 therefore flows generally away from and perpendicularly to the plane 112. From the oil inlet 84, oil flows (as indicated by arrow 113 in FIG. 8) into a channel 114 (FIG. 7) generally aligned with the oil inlet 84. The channel 114 is integrally formed in the oil tank enclosure 98. From the channel 114, the oil flows over an angled portion 116 of the oil tank enclosure 98. By flowing over the angled portion 116, blow-by gases present in the oil being returned to the oil tank 18 via the inlet 84 get separated from the oil and flow to the top of the oil tank 18 (as indicated by arrow 118 in FIG. 8) while the oil flows down into the oil tank 18 (as indicated by arrow 120 in FIG. 8). An angle 8 (FIG. 8) between the angled portion 116 and the plane 112 is preferably between 45 and 80 degrees.

As can be seen in FIGS. 3 to 5 and 7, a portion of the oil passage 64 is formed between the crankcase 12 and the oil tank enclosure 98. The oil inlet 65 is disposed lower in the oil tank 18 than the oil inlet 84, such that when the engine 10 is level, the oil inlet 65 is disposed below the oil level (indicated by line 108). The oil inlet 65 is disposed in the left portion (as viewed in FIGS. 3 and 4) of the oil tank 18.

As can be seen in FIG. 3, the oil outlet 43 is formed in the crankcase 12 at the bottom of the oil tank 18. The oil outlet 43 is disposed generally in the center of the lower end portion (i.e. lower third) of the oil tank 18, such that even when the engine 10 (and therefore the oil tank 18) becomes tilted (but not inverted), oil is still present over the oil outlet 43, and as such oil can continue to be supplied to the various parts of the engine 10.

As can be seen in FIGS. 3 to 5 and 7, a tortuous blow-by passage 122 is formed between the crankcase 12 and the oil tank enclosure 98. The blow-by gas outlet 90 is formed at one end of the tortuous blow-by passage 122. The blow-by gas outlet 90 is disposed in the upper end portion (i.e. upper third) of the oil tank 18, vertically higher than the oil inlet 84. As can be seen, the blow-by gas outlet 90 is disposed generally at the center of the length of the upper end portion of the oil tank 18 (as measured in a direction generally parallel to the crankshaft axis 30). By locating the blow-by gas outlet 90 in this position, the blow-by outlet 90 remains above the oil level (i.e. opened) even when the engine 10 (and therefore the oil tank 18) becomes tilted (but not inverted) over a broad range of angles. Therefore, blow-by gases can continue to be vented through the blow-by gas outlet 90 even though the engine is tilted (within the broad range of angles). Lines 124A to 124D in FIGS. 4 and 8 show the oil level when the engine 10 is tilted in various directions. Note that lines 124A to 124D do not represent the maximum angle by which the engine 10 could be tilted while still maintaining the blow-by gas outlet 90 opened.

Figure 5:
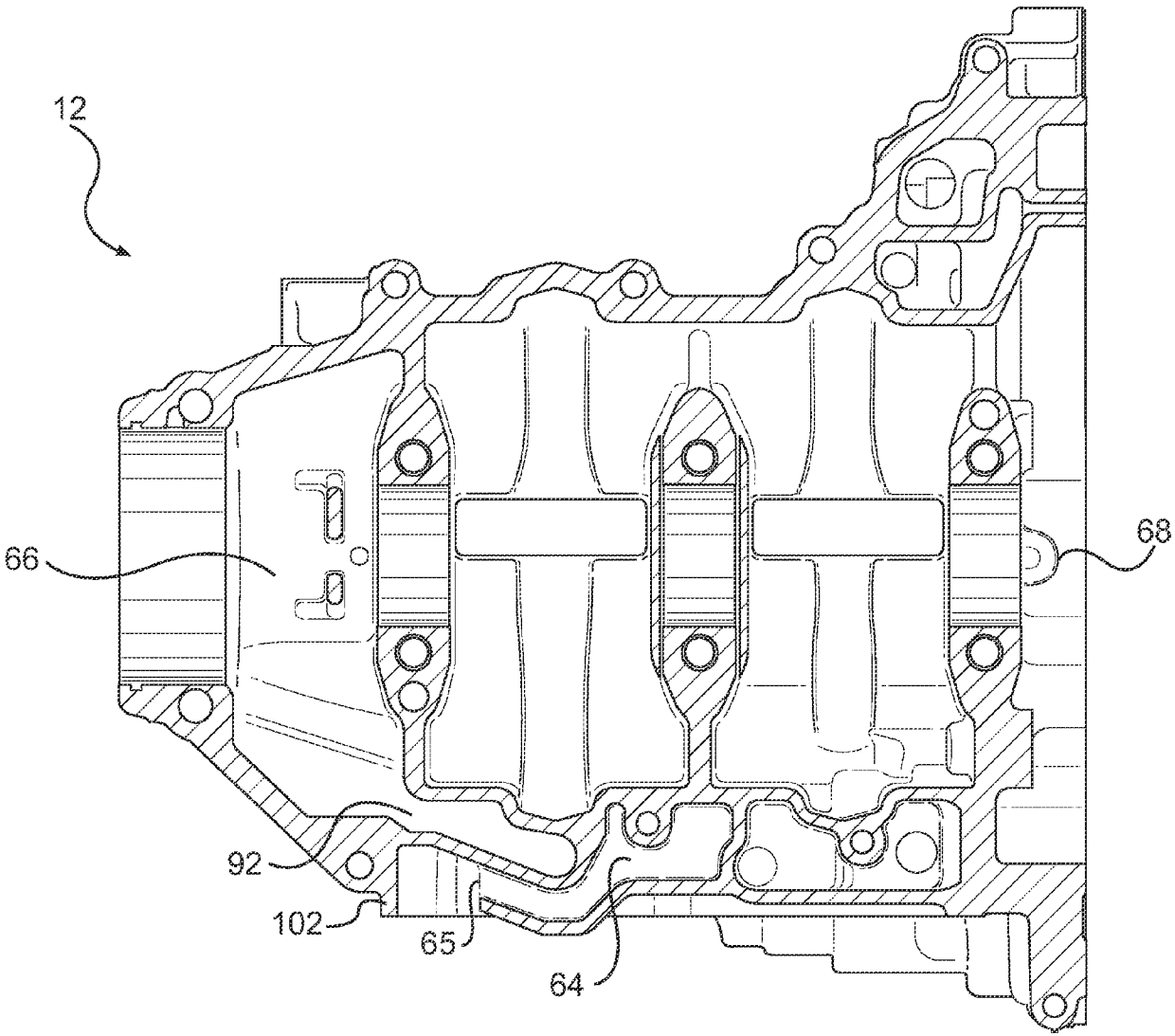
FIG. 5 is a cross-sectional view, taken through line A-A of FIG. 4, of the crankcase of FIG. 3.

When the blow-by gas outlet 90 is opened, blow-by gases in the oil tank 18 flows in the tortuous blow-by gas passage 122 via the blow-by gas outlet 90. From the tortuous blow-by gas passage 122, blow-by gases flow away from the cylinder head assembly 16 in the blow-by gas passage 92. As seen in FIGS. 4 and 5, the blow-by gas passage 122 is formed in the crankcase 12. As previously described, from the blow-by gas passage 92, blow-by gases enter the chamber 66, and flow towards the cylinder head assembly 16 in the chain case 60 to the cylinder head assembly 16. It is contemplated that a separate blow-by gas passage running from the chamber 66 to the cylinder head assembly 16 could be used instead of the chain case 60 to run the blow-by gases to the cylinder head assembly 16. Once in the cylinder head assembly 16, the blow-by gases flow through the blow-by gas separator 94, enter the blow-by tube 96 and flow to an exterior of the engine 10 (in this case the air box 36). The blow-by gas passage 92, the chamber 66, and the chain case 60 together form a generally U-shaped passage. By having a passage with this shape, when the blow-by gas outlet 90 becomes closed (i.e. below the oil level), such as when the engine 10 (and therefore the oil tank 18) becomes inverted, oil present in the oil tank 18 will not flow into the cylinder head assembly 16, which would otherwise fill it, thus causing oil to flow to the exterior of the engine 10 via the blow-by tube 96. When the engine 10 becomes inverted only oil present in the chain case 60, a portion of the oil present in oil passages that communicate directly with the cylinder head assembly 16, and a portion of the oil in the chamber 66 flow to the cylinder head assembly 16. However this amount of oil is insufficient to fill the cylinder head assembly 16 with oil, and therefore oil will not escape the engine 10.

The oil inlet 65 is positioned in the oil tank 18 such that when the blow-by gas outlet 90 is below the oil level, the oil inlet 65 is disposed above the oil level. As an example, when the engine 10 is arranged such that the crankshaft 26 is generally vertical (with the chain case 60 now located at the top of the engine), the blow-by gas outlet 90 is disposed below the oil level (i.e. to the right of oil level line 126 as viewed in FIG. 4), but the oil inlet 65 is above the oil level. As another example, when the engine 10 (and therefore the oil tank 18) becomes inverted, the blow-by gas outlet 90 is disposed below the oil level (i.e. above oil level line 128 as viewed in FIG. 4), but the oil inlet 65 is above the oil level. Therefore, when the blow-by gas outlet 90 is below the oil level, blow-by gases and oil vapour are evacuated from the oil tank 18 via the oil inlet 65. When blow-by gases and oil vapour are evacuated from the oil tank 18 via the oil inlet 65, they flow from the oil inlet 65 to the cylinder head assembly via the oil passage 64, and are then evacuated to the exterior of the engine 10 as previously described.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An internal combustion engine comprising:

a crankcase;

a crankshaft disposed in the crankcase, the crankshaft defining a crankshaft axis;

a cylinder block disposed on the crankcase, the cylinder block having at least one cylinder, the at least one cylinder defining a cylinder axis;

at least one piston disposed in the at least one cylinder, the at least one piston being operatively connected to the crankshaft;

a cylinder head assembly connected to the cylinder block;

a plurality of oil passages disposed in at least one of the crankcase, the cylinder block, and the cylinder head assembly;

an oil tank fluidly connected to at least one of the oil passages, the oil tank having a first side and a second side opposite the first side;

an oil outlet disposed in the oil tank, the oil outlet fluidly communicating the oil tank with at least one of the oil passages for supplying oil from the oil tank to the oil passages; and an oil inlet disposed in the first side of the oil tank, the oil inlet fluidly communicating with at least one of the plurality of oil passages for returning a mixture of oil and blow-by gases from the at least one of the plurality of oil passages to the oil tank, an angled portion of the second side of the oil tank generally facing the oil inlet being angled relative to a plane defined by the crankshaft axis and the cylinder axis such that the mixture of oil and blow-by gases exiting the oil inlet flow over the angled portion, the angled portion being angled relative to the oil inlet, the angled portion being spaced from a bottom of the oil tank, and the angled portion extending away from the plane as the angled portion extends upwardly, an angle between the angled portion of the second side of the oil tank and the plane is between 45 degrees and 80 degrees.

2. The engine of claim 1, further comprising a blow-by gas outlet fluidly communicating the oil tank with an exterior of the engine.

3. The engine of claim 1, wherein the first side of the oil tank is at least in part an outer wall of the crankcase; and wherein the second side of the oil tank is an oil tank enclosure connected to the crankcase.

4. An internal combustion engine comprising:

a crankcase;

a crankshaft disposed in the crankcase, the crankshaft defining a crankshaft axis;

a cylinder block disposed on the crankcase, the cylinder block having at least one cylinder, the at least one cylinder defining a cylinder axis;

at least one piston disposed in the at least one cylinder, the at least one piston being operatively connected to the crankshaft;

a cylinder head assembly connected to the cylinder block;

a plurality of oil passages disposed in at least one of the crankcase, the cylinder block, and the cylinder head assembly;

an oil tank fluidly connected to at least one of the oil passages, the oil tank having a first end portion and a second end portion opposite the first end portion, the first end portion being closer to the cylinder head assembly than the second end portion;

an oil outlet disposed in the second end portion of the oil tank for supplying oil from the oil tank to at least one of the crankcase, the cylinder block, and the cylinder head assembly;

an oil inlet disposed in the oil tank for returning oil from at least one of the crankcase, the cylinder block, and the cylinder head assembly to the oil tank;

a blow-by gas outlet disposed in the first end portion of the oil tank; and a blow-by gas passage fluidly communicating the blow-by gas outlet with an exterior of the engine, a first portion of the blow-by gas passage extending from the blow-by gas outlet in a direction generally away from the cylinder head assembly, a second portion of the blow-by gas passage extending from the first portion of the blow-by gas passage in a direction generally towards the cylinder head assembly, such that when the first end portion of the oil tank is disposed generally vertically above the second end portion of the oil tank, blow-by gases in the oil tank flow sequentially from the oil tank to the blow-by gas outlet, to the first portion of the blow-by gas passage, to the second portion of the blow-by gas passage, and to the exterior of the engine, and the oil inlet being arranged in the oil tank such that when the first end portion of the oil tank is disposed generally vertically below the second end portion of the oil tank, blow-by gases in the oil tank flow sequentially from the oil tank to the oil inlet, and to the exterior of the engine.

5. The engine of claim 4, wherein the blow-by gas outlet is disposed generally at a center of a length of the first end portion of the oil tank;

wherein the length of the first end portion of the oil tank is generally parallel to the crankshaft axis.

6. The engine of claim 4, wherein the oil inlet returns oil from the cylinder head assembly; and wherein when the first end portion of the oil tank is disposed generally vertically below the second end portion of the oil tank, blow-by gases in the oil tank flow to the cylinder head assembly prior to flowing to the exterior of the engine.

7. The engine of claim 4, wherein the oil inlet is a first oil inlet;

the engine further comprising a second oil inlet in the oil tank for returning oil from at least one other of the crankcase, the cylinder block, and the cylinder head assembly to the oil tank;

wherein the first and second oil inlets are disposed between the blow-by gas outlet and the oil outlet in a direction generally parallel to the cylinder axis; and wherein the first oil inlet is disposed closer than the second oil inlet to the blow-by gas outlet.

8. The engine of claim 7, further comprising at least one oil pump, the at least one oil pump pumping oil from at least one of the crankcase and the cylinder block to the oil tank;

wherein the first oil inlet returns oil from the at least one oil pump; and wherein the second oil inlet returns oil from the cylinder head assembly.

9. The engine of claim 4, wherein the first portion of the blow-by gas passage extends in the crankcase;

wherein the second portion of the blow-by gas passage is a timing chain case of the engine fluidly communicating with the cylinder head assembly; and wherein when the first end portion of the oil tank is disposed generally vertically above the second end portion of the oil tank, blow-by gases in the oil tank flow to the cylinder head assembly prior to flowing to the exterior of the engine.

10. The engine of claim 4, wherein when the first end portion of the oil tank is disposed generally vertically above the second end portion of the oil tank, blow-by gases in the oil tank flow to the cylinder head assembly prior to flowing to the exterior of the engine; and the engine further comprising a blow-by gas separator disposed in the cylinder head assembly for separating oil from the blow-by gases prior to the blow-by gases flowing to the exterior of the engine.

11. The engine of claim 4, wherein the oil tank is formed by an outer wall of the crankcase and by an oil tank enclosure connected to the crankcase.

12. An internal combustion engine comprising:

a crankcase;

a crankshaft disposed in the crankcase, the crankshaft defining a crankshaft axis;

a cylinder block disposed on the crankcase, the cylinder block having at least one cylinder, the at least one cylinder defining a cylinder axis;

at least one piston disposed in the at least one cylinder, the at least one piston being operatively connected to the crankshaft;

a cylinder head assembly connected to the cylinder block;

a plurality of oil passages disposed in at least one of the crankcase, the cylinder block, and the cylinder head assembly;

an oil tank fluidly connected to at least one of the oil passages, the oil tank having a first end portion and a second end portion opposite the first end portion, the first end portion being closer to the cylinder head assembly than the second end portion;

an oil outlet disposed in the second end portion of the oil tank for supplying oil from the oil tank to at least one of the crankcase, the cylinder block, and the cylinder head assembly;

a first oil inlet disposed in the oil tank for returning oil from at least one of the crankcase, the cylinder block, and the cylinder head assembly to the oil tank;

a second oil inlet in the oil tank for returning oil from at least one other of the crankcase, the cylinder block, and the cylinder head assembly to the oil tank;

a blow-by gas outlet disposed in the first end portion of the oil tank, the first and second oil inlets being disposed between the blow-by gas outlet and the oil outlet in a direction generally parallel to the cylinder axis; and a blow-by gas passage fluidly communicating the blow-by gas outlet with an exterior of the engine, a first portion of the blow-by gas passage extending from the blow-by gas outlet in a direction generally away from the cylinder head assembly, a second portion of the blow-by gas passage extending from the first portion of the blow-by gas passage in a direction generally towards the cylinder head assembly, such that when the first end portion of the oil tank is disposed generally vertically above the second end portion of the oil tank, blow-by gases in the oil tank flow sequentially from the oil tank to the blow-by gas outlet, to the first portion of the blow-by gas passage, to the second portion of the blow-by gas passage, and to the exterior of the engine.

13. The engine of claim 12, wherein the blow-by gas outlet is disposed generally at a center of a length of the first end portion of the oil tank;

wherein the length of the first end portion of the oil tank is generally parallel to the crankshaft axis.

14. The engine of claim 12, wherein the second oil inlet is arranged in the oil tank such that when the first end portion of the oil tank is disposed generally vertically below the second end portion of the oil tank, blow-by gases in the oil tank flow sequentially from the oil tank to the second oil inlet, and to the exterior of the engine.

15. The engine of claim 14, wherein the second oil inlet returns oil from the cylinder head assembly; and wherein when the first end portion of the oil tank is disposed generally vertically below the second end portion of the oil tank, blow-by gases in the oil tank flow to the cylinder head assembly prior to flowing to the exterior of the engine.

16. The engine of claim 12, wherein the first oil inlet is disposed closer than the second oil inlet to the blow-by gas outlet.

17. The engine of claim 16, further comprising at least one oil pump, the at least one oil pump pumping oil from at least one of the crankcase and the cylinder block to the oil tank;

wherein the first oil inlet returns oil from the at least one oil pump; and wherein the second oil inlet returns oil from the cylinder head assembly.

18. The engine of claim 12, wherein the first portion of the blow-by gas passage extends in the crankcase;

wherein the second portion of the blow-by gas passage is a timing chain case of the engine fluidly communicating with the cylinder head assembly; and wherein when the first end portion of the oil tank is disposed generally vertically above the second end portion of the oil tank, blow-by gases in the oil tank flow to the cylinder head assembly prior to flowing to the exterior of the engine.

19. The engine of claim 12, wherein when the first end portion of the oil tank is disposed generally vertically above the second end portion of the oil tank, blow-by gases in the oil tank flow to the cylinder head assembly prior to flowing to the exterior of the engine; and the engine further comprising a blow-by gas separator disposed in the cylinder head assembly for separating oil from the blow-by gases prior to the blow-by gases flowing to the exterior of the engine.

20. The engine of claim 12, wherein the oil tank is formed by an outer wall of the crankcase and by an oil tank enclosure connected to the crankcase.

* * * * *